US005190633A

United States Patent [19]

Fetzer et al.

[11] Patent Number: 5,190,633

[45] Date of Patent: Mar. 2, 1993

[54] HYDROCRACKING PROCESS WITH POLYNUCLEAR AROMATIC DIMER FOULANT ADSORPTION

[75] Inventors: John C. Fetzer, Hercules; David G. Lammel, San Rafael, both of Calif.

[73] Assignee: Chevron Research and Technology Company, San Francisco, Calif.

[21] Appl. No.: 853,680

[22] Filed: Mar. 19, 1992

[51] Int. Cl.[5] ..... C10G 67/06

[52] U.S. Cl. ..... 208/99; 208/111; 208/48 R; 208/310 R; 208/310 Z

[58] Field of Search ..... 208/99

[56] References Cited

U.S. PATENT DOCUMENTS

| | | | |
|---|---|---|---|
| 2,937,215 | 5/1960 | Bleich et al. | 208/99 |
| 2,983,668 | 5/1961 | Hemminger | 208/99 |
| 3,204,006 | 8/1965 | Broughton | 208/99 |
| 4,447,315 | 5/1984 | Lamb et al. . | |
| 4,921,595 | 5/1990 | Gruia | 208/99 |
| 4,954,242 | 9/1990 | Gruia | 208/99 |
| 5,007,998 | 4/1991 | Gruia | 208/99 |

*Primary Examiner*—Helane Myers

*Attorney, Agent, or Firm*—W. Keith Turner; Robert D. Touslee

[57] ABSTRACT

A process for separation and removal of stable polycyclic aromatic dimer foulants from refinery process streams by selectively adsorbing the foulants while eluting non-fouling smaller-ringed aromatics. Synchronous Scanning Fluorescence may be used in the identification and monitoring of the stable polycyclic aromatic dimers.

11 Claims, 2 Drawing Sheets

HYDROCRACKING PROCESS WITH POLYNUCLEAR AROMATIC DIMER FOULANT ADSORPTION

BACKGROUND OF THE INVENTION

The present invention relates to the removal of compounds from petroleum refinery streams which have been determined to foul process equipment. More specifically, it relates to a process for separating large, stable polycyclic aromatic compounds which form during the hydrocracking process and which foul process equipment by scaling which results in plugging flow in and around such equipment.

Petroleum refinery hydrocracking processes are well known and developed. Such processes upgrade mixtures of hydrocarbons to supply more valuable product streams.

Hydrocracking is a high severity hydrotreating operation in which high molecular weight compounds are cracked to lower boiling materials. Severity is increased by operating with increasingly acidic catalysts and possibly at higher temperatures and longer contact times than in hydrotreating. Increased hydrogen pressure controls deposits and catalyst fouling. Unlike thermal or catalytic cracking, hydrocracking decreases the molecular weight of aromatic compounds and fills a specific need for processing streams high in aromatic material, such as cycle stocks from catalytic or thermal cracking, coker products, or coal liquids. For example, catalytic cycle stock can be cracked to a naphtha fraction that is an excellent feed for catalytic reforming to make premium-octane gasoline or petrochemical aromatic material Hydrocracking is used extensively on distillate stocks. The hydrocracking process is applied to refinery stocks for premium-quality kerosene, diesel and jet fuels. The light products from hydrocracking are also rich in isobutane, an important raw material for alkylation.

Hydrocracking is of increasing importance in view of the trend to heavier crudes and the need for processing synthetic crudes.

As demand for distillate fuels increased, refiners installed hydrocrackers to convert Vacuum Gas Oil (VGO) to jet and diesel. Catalysts were developed that exhibited excellent distillate selectivity, high conversion activity and stability for heavier feedstocks.

A trend in recent years in the push for higher yields of liquid products from hydrocracking units has been the use of longer life catalysts having an increasing amount of molecular sieve. A well known class of catalysts with a higher degree of molecular sieve are the "zeolite" type catalysts.

One result of the zeolitic catalyst in hydrocracking reactors is the formation of compounds in a class known as polycyclic aromatic compounds, or alternatively "polynuclear aromatics", or "PNA". Additionally, these polycyclic aromatic compounds were known to contribute to catalyst fouling and coking. The formation of polycyclic aromatic compounds has been found to increase during the catalyst run as hydrocracker temperatures increase.

In recent times, as the worldwide supply of light, sweet crude oil for refinery feedstock has become more scarce, there has been a significant trend toward conversion of higher boiling compounds to lower boiling ones. This "bottom of the barrel" or "hard processing" has increased potential downstream fouling problems by tending to create even greater quantities of heavier, converted cyclic compounds, such as polycyclic aromatics, in the initial stages of the refining process. The addition such process units as residual desulfurization units, makes the need for an economic solution to the fouling problem even more desirable.

In addition to high conversion distillate production, another trend in the 1980's has been to send unconverted fractionator bottoms from the hydrocracker to units such as FCC units, ethylene crackers and lube plants which benefit from highly paraffinic feedstocks. The fractionator bottoms material is desulfurized, denitrified and highly saturated during its residence time in the hydrocracker. The polycyclic aromatic compounds formed during the hydrocracking process, however, are quite undesirable in these other process units.

Extinction recycle hydrocrackers suffer from equipment fouling and plugging in the cooler portions of the process due to precipitation of certain polycyclic aromatic compounds.

U.S. Pat. No. 3,619,407 issued on Nov. 9, 1971 to Hendricks et al. describes one hydrocracking catalyst for use in a hydrocracking process, and is further relevant in describing certain aspects of the problem which is addressed by the present invention. The reference discloses the problem of the formation of polycyclic aromatic compounds which are identified in the reference as being "benzocorenene". The reference describes the known tendency for such compounds to "plate out" onto cooler downstream equipment such as heat exchanger surfaces. The claimed solution described in the reference is the withdrawal or "bleeding" of a significant portion of the hydrocracker effluent from the hydrocracking zone to a lower value stream such as fuel oil, in order to reduce the concentration of polycyclic aromatics existing in such effluent.

U.S. Pat. No. 4,447,315 issued on May 8, 1984 to Lamb et al. discloses a process scheme for reducing the concentration of certain polycyclic aromatic compounds, referred to in U.S. Pat. No. 4,447,315 as "PNA or benzocorenenes" in a hydrocracking process by separating hydrocracker effluent in a fractionator, and contacting fractionator bottoms in an adsorption unit with an adsorbent which selectively retains the "PNA compounds" described in U.S. Pat. No. 4,447,315, and recycling the fractionator bottoms back to the hydrocracking reactor.

U.S. Pat. No. 5,007,998, issued Apr. 16, 1991 to Gruia teaches a process for minimizing "11+ ring heavy PNA compounds" by hydrogenating a portion of the unconverted bottoms from a hydrocracking process in a separate reactor containing a zeolite catalyst.

In a technical paper by Sullivan et. al. entitled "Molecular Transformations in Hydrotreating and Hydrocracking", Journal of Energy and Fuels, Vol.3 p.603 (1989), which is fully incorporated by reference herein, assumptions about the route to the formation of large polycyclic aromatic compounds are discussed.

An effective and economical process for the removal of stable polycyclic aromatic compounds is much desired as a means of reducing fouling of refinery process equipment and catalyst coking.

A process for the identification and removal of stable polycyclic aromatic dimers found to foul equipment in a hydrocracking process, which process minimizes wastage of valuable streams and requires minimum capital investment and operating expense is much desired.

The present invention achieves the above desired outcomes without the shortcomings of the above processes.

Co-pending Application No. 567,427, assigned to the assignee of the present invention discloses a process for the selective precipitation and separation of stable polycyclic aromatic dimers present in hydrocracker effluent.

SUMMARY OF THE INVENTION

In accordance with the present invention, a process for removing stable polycyclic aromatic dimers from hydrocarbonaceous refinery streams is provided. The process comprises the steps of:

(a) recovering a heavy effluent stream from a hydrocracker which heavy effluent stream comprises stable polycyclic aromatic dimer compounds and smaller-ringed aromatic compounds;

(b) contacting at least a portion of the heavy effluent stream with an adsorbent contained in an adsorbant zone whereby a major portion of stable polycyclic aromatic dimer compounds contained in the heavy effluent stream are retained and a majority of the smaller-ringed aromatics elute from the adsorption zone to produce an adsorber effluent stream having a reduced concentration of stable polycyclic aromatic dimer compounds; and (c) recycling at least a portion of adsorber effluent stream to the hydrocracking reactor.

Having the knowledge of the specie or species of polycyclic aromatic dimer present in the system, and which is sought to be removed, is important in the practice of the present invention.

Among other factors, the present invention is based upon our finding that fouling compounds present in the problematic hydrocarbon refinery streams are predominantly unsubstituted and alkyl substituted isomers of dicoronylene, coronylovalene, diovalylene, or mixtures thereof, (hereinafter alternatively referred to as polycyclic aromatic dimers, or "PAD"). These dimers are stable compounds as compared to relatively unstable class of compounds known only as polycyclic or polynuclear aromatics, or unstable "PNA's", which class includes relatively unstable 11+ ring PNA compounds and the 8 ring "benzocorenene".

The dimerization reaction we now have determined to be dominant is depicted in FIG. 1. Prior to this discovery, it was believed that the foulants were compounds of lesser molecular weight such as coronene and benzocoronene. Knowledge of the specific fouling compounds allows for the monitoring of their concentration or presence in, for example, the recycle stream.

The greater polarity of the above stable polycyclic aromatic dimers, relative to smaller-ringed aromatics allows for higher loadings in a packed adsorbent column. In the practice of the present invention, smaller-ringed and less polar aromatics such as coronene, ovalene and the like will tend to be displaced and eluted from such a packed absorber column by the larger and more polar dimers.

Surprisingly, we found that it was possible to detect extremely small concentrations of fouling PAD compounds in the much greater presence of smaller-ringed aromatics. Using Synchronous Scanning Fluorescence we discovered the smaller-ringed aromatics leave a window range of fluorescence corresponding to the fluorescence range of the fouling polycyclic aromatic dimers.

With the foregoing discovery and knowledge, a refiner practicing the process of our present invention may avoid very large investments in adsorbents and equipment by achieving higher adsorbent loading, as well as lessen the frequency of required regeneration of the adsorbent beds.

Though applicable to any refinery stream which may contain stable polycyclic aromatic dimer, we have found the present invention particularly applicable to treating hydrocracking reactor effluents, more particularly effluents produced where the hydrocracker feedstock is a vacuum gas oil, and especially where the vacuum gas oil has been contacted with a catalyst, such as in a residual desulfurization (RDS) process, prior to entering the hydrocracking reactor. This invention is also particularly applicable to hydrocracker feedstocks such as resid-derived vacuum gas oils, coker gas oils and FCC cycle oils, especially those for cycle oils derived from FCC units feeding resid.

We have found the present process to be particularly advantageous in treating effluent streams from fixed-bed reactors, though the invention not so limited.

An important aspect of the present invention is that only a very small portion of the valuable hydrocracking reactor effluent is removed, as opposed to prior known methods which called for systematic withdrawal or "bleeding" of material from the hydrocracker heavy effluent and recycle loop for the sole purpose of reducing the concentration of suspected contaminants. This aspect of our present invention is an advantage in achieving the highest value refinery products from the conversion of the hydrocracker feed, as the bleed streams of the prior processes are typically blended into a lower value fuel oil stream or the like.

A further important aspect of the present invention is that it acts upon the foulant stable polycyclic aromatic dimers themselves, not what we have found to be dimer precursors such as coronene or ovalene, or the less stable "benzocorenes" which we have found to be outside the cause of equipment fouling. These smaller-ringed aromatics may thus be converted to higher value products.

DETAILED DESCRIPTION OF THE PREFERRED EMBODIMENTS

As used herein, the term "hydrocracking" means a process which consumes hydrogen and converts a hydrocarbonaceous stream, such as a petroleum fraction, to a hydrocarbon product, in which at least a portion of the high molecular weight compounds in the feed are cracked to lower boiling materials. Example feedstreams to a hydrocracking reactor include vacuum gas oil, gas oil, heavy oil, reduced crude, and vacuum distillation residua. Hydrocracking reaction effluents are generally a two-phase mixture of liquid and gases, where under typical operating conditions the principal components of the liquid phase of the effluent are $C_5$ and higher hydrocarbons.

The term "polycyclic aromatic dimer" or "PAD" is used here to connote stable dimerized compounds, not tending to further react or dimerize, resulting from the Schöll condensation of molecules resulting from one ring additions to naphthalene. Examples include the unsubstituted and the alkyl-substituted isomers of dicoronylene, coronylovalene, and diovalene, or mixtures thereof, which result from the Schöll condensation of coronene, ovalene or both.

Figure 1:
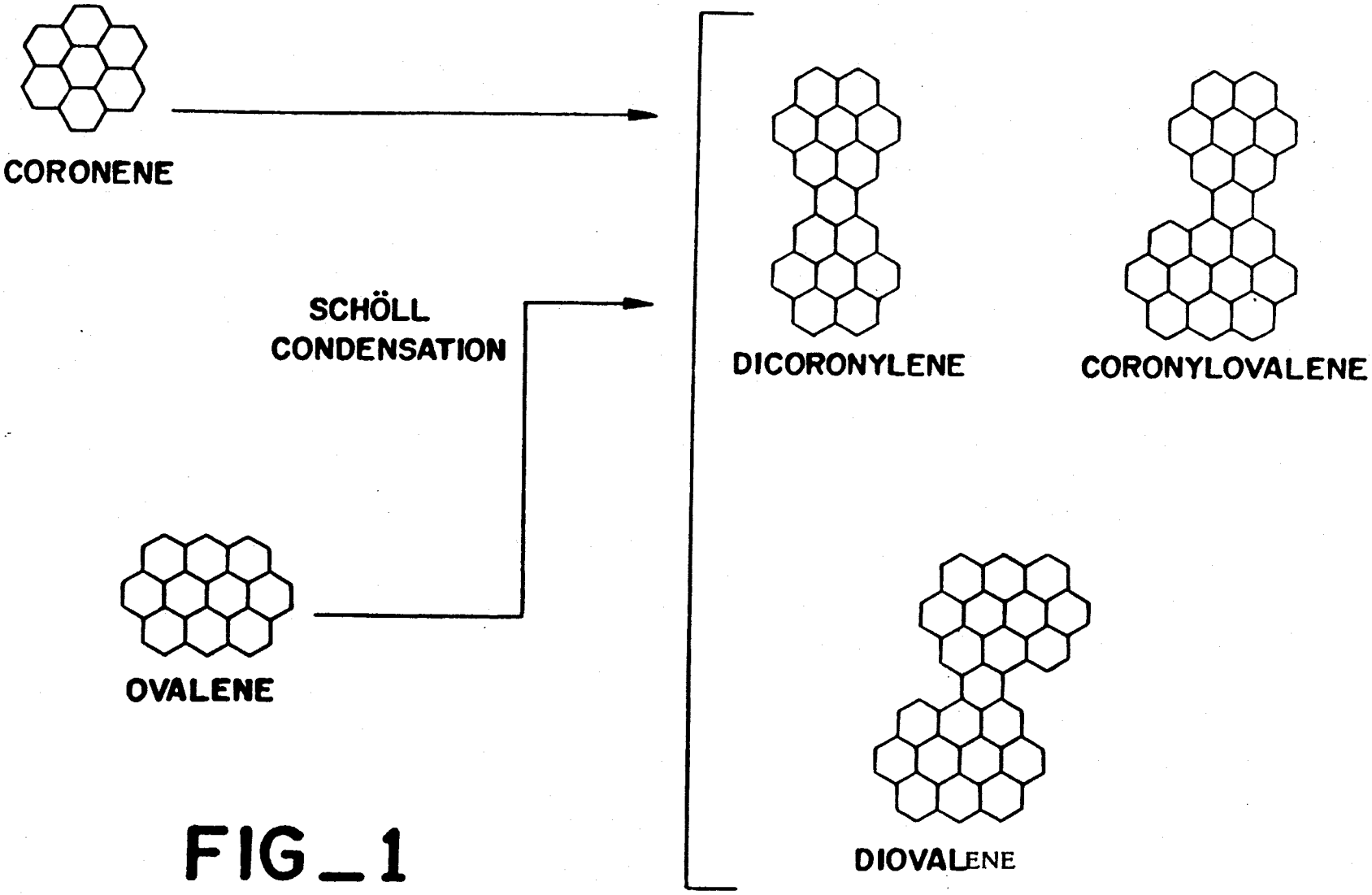
FIG. 1 is a representation of the chemical reaction creating the foulant stable polycyclic aromatic dimer compounds.

Referring to FIG. 1, the reaction is depicted from which the PAD's we have discovered to be primarily responsible for equipment fouling are formed.

The term "adsorbent" is used here to connote any well-known adsorbent capable of adsorbing polar aromatic compounds.

The classical adsorbents which demonstrate high adsorptivity for polynuclear aromatic compounds include alumina and silica gel. Other polynuclear aromatic compound adsorbents include cellulose acetate, synthetic magnesium silicate, macroporous magnesium silicate, macroporous polystyrene gel and graphitized carbon black. All of the above-mentioned adsorbents are mentioned in a book authored by Milton L. Lee et al. entitled "Analytical Chemistry of Polycyclic Aromatic Compounds" and published by Academic Press, New York in 1981.

Suitable adsorbents include, for example, molecular sieves, silica gel, activated carbon, activated alumina, silica-alumina gel, and clays. Of course, it is recognized that for a given case, a particular adsorbent may give better results than others.

The selected adsorbent is contacted with the hydrocarbon containing polynuclear aromatic compounds in an adsorption zone. The adsorbent may be installed in the adsorption zone in any suitable manner. A preferred method for the installation of the adsorbent is in a fixed bed arrangement. The adsorbent may be installed in one or more vessels and in either series or parallel flow. The spent zone of adsorbent may be regenerated or the spent adsorbent may be replaced as desired.

The adsorption zone is maintained at a pressure from about 30 psig to about 300 psig, preferably from about 35 psig to about 200 psig, a temperature from about 200° F. to about 700° F., and a liquid hourly space velocity from about 1 to about 100, preferably from about 5 to about 80. The flow of the hydrocarbons through the adsorption zone may be conducted in an upflow, downflow or radial flow manner. The temperature and pressure of the adsorption zone are preferably selected to maintain the hydrocarbons in the liquid phase. The resulting unconverted hydrocarbon oil having a reduced concentration of polynuclear aromatic compounds is then recycled to the hydrocracking zone for further processing and subsequent conversion to lower boiling hydrocarbons.

Figure 2:
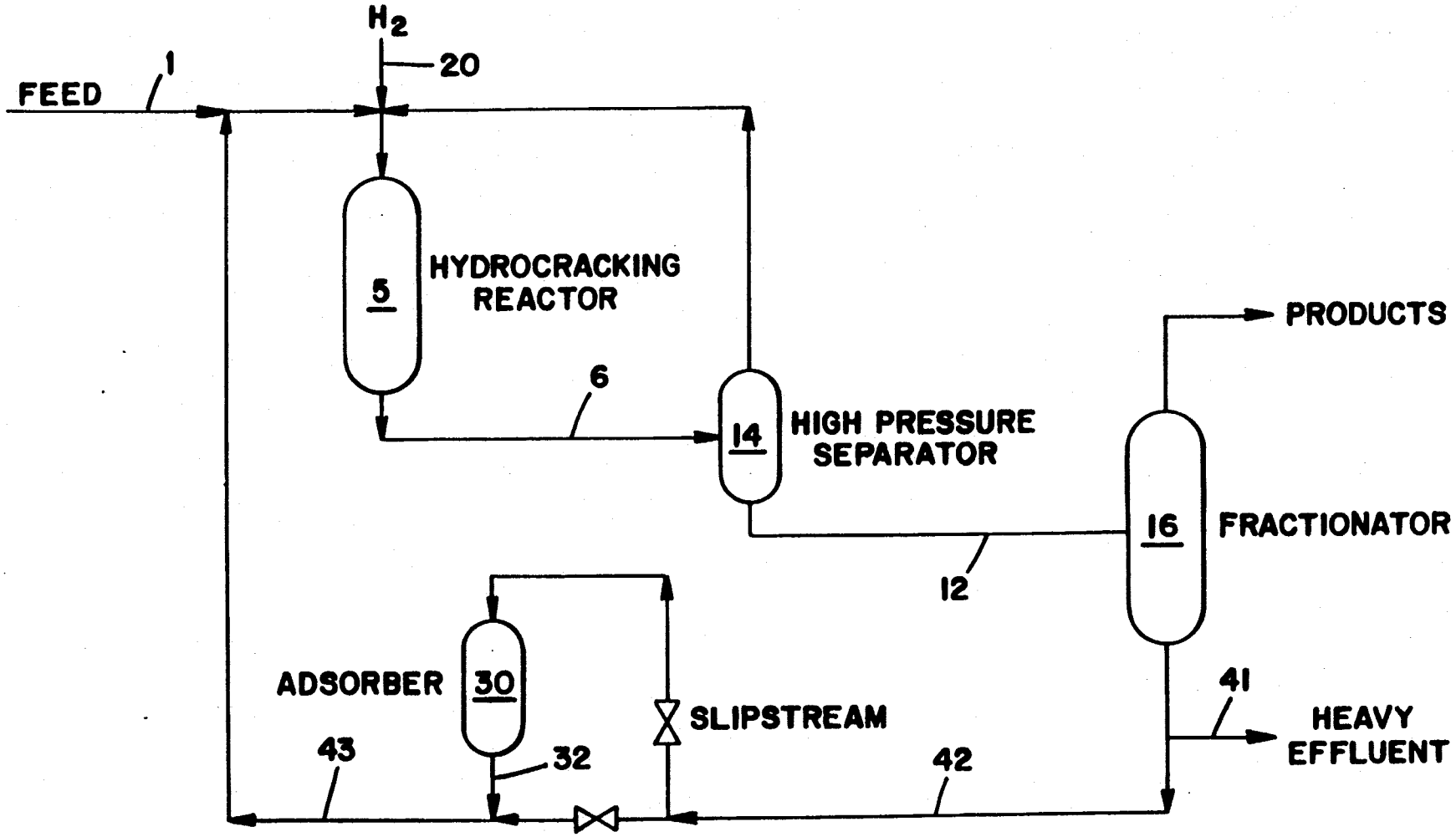
FIG. 2 is a schematic flow diagram illustrating a preferred embodiment of the present invention.

Referring to FIG. 2, a feedstream is introduced via stream 1, and may be a hydrocarbonaceous feed typical for hydrocracking. Preferred feeds are vacuum gas oil boiling from about 650° F–1100° F. and gas oils boiling from about 400° F.–650° F. The present process is especially advantageous when applied to hydrocracker feeds which are vacuum gas oil boiling around 650° F.–1100° F.

Hydrogen, in the form of net recycle hydrogen or makeup, is introduced to the process via stream 20, and when compressed to process pressure of about 750 psig to about 10,000 psig, or typically 1,000 psig to 4,000 psig, is introduced with the hydrocarbonaceous feed to the hydrocarbon conversion zone 5, which may be either a single-stage "extinction" recycle reactor or the second-stage "extinction" recycle reactor of a two-stage hydrocracker. It should be noted that FIG. 2 is a simplified process diagram and many pieces of process equipment, such as separators, heaters and compressors, have been omitted for clarity.

The temperature and pressure of the hydrocracking reactor 5, which indicates process severity along with other reaction conditions, vary depending on the feed, the type of catalyst employed, and the degree of hydroconversion sought in the process. The effluent from the hydrocracking reactor exits the hydrocracking zone 5 via stream 6 and passes to a separator zone 14 in one embodiment of the present invention, before being passed via stream 12 to fractionator 16. Converted products are taken overhead from the fractionator 16. Heavy unconverted oil is taken from the bottom of the fractionator 16, then recycled via streams 42 and 43 to the hydrocracking zone 5 for further conversion.

In the embodiment depicted by FIG. 2, there was foulant build-up, prior to our discovery, primarily in the coolest portions of the recycle loop, depicted in FIG. 2 comprising streams 6, 12, 42, and 43. To control the rate of foulant accumulation, it was previously thought necessary to withdraw or "bleed" a significant portion of the valuable heavy effluent material, as depicted in FIG. 2 by stream 41. This bleed was typically blended off to fuel oil, sent to a coker, or perhaps to a FCC.

In the preferred embodiment of our invention, we have found it particularly advantageous to remove a portion of the polycyclic aromatic dimers contained in effluent stream 42 therein which are foulant compounds having a propensity to drop out of liquid solution and plug refinery equipment. Typical concentrations of dicoronylene in fractionator bottoms heavy effluent stream, corresponding to stream 42 in FIG. 2, at one large refinery range between 30–70 parts per billion, depending on the bleed rate. Concentration of dicoronylene in hydrocracking reactor effluent streams, depicted by stream 6 and stream 12 in FIG. 2, range between 50 and 200 parts per billion.

Selective removal of the foulant stable polycyclic aromatic dimer compounds is accomplished in the process of our present invention by selectively adsorbing a portion of the stable PAD compounds in an adsorption column. The greater polarity of the dicoronylene and coronylovalene and other PAD's we have discovered to be primary foulants compared to the smaller "11-ringed PNA's", benzocoronenes and similarly smaller-ringed aromatics can allow the adsorption column to be operated at a higher loading rate. Smaller, less polar aromatics such as coronylene, ovalene and the like will tend to be displaced and eluted from the adsorber column, relative to the large PAD compounds.

Although feed to the adsorption column is depicted in the preferred embodiment of FIG. 2 as recycle oil from the fractionator 16, it may be located at any convenient location within the recycle loop such as, for example, the feed to the fractionator column. The hydrocarbon oil in any of the streams within the recycle loop will carry some concentration of the PAD.

We have found the concentration of stable foulant polycyclic aromatic dimer compounds in the heavy effluent recycle oil to be typically less than about 200 parts per billion, most frequently found to be in the range of about 50 ppb to about 100 ppb.

We also now know that the foulant stable PAD compounds are only soluble in the heavy effluent recycle oil up to a concentration of about 200 parts per million, or even less depending on the particular oil.

We have achieved good overall results in the selective adsorption of foulant polycyclic aromatic dimers formed in a hydrocracking process when the adsorption column is operated to selectively adsorb primarily PAD compounds and the effuent therefrom monitored for the foulant PAD compounds. Compared to the equipment and amount of adsorbent required to remove smaller-ringed aromatic compounds, typically present in concentrations of up to 10,000 parts per million, the adsorbent usage in the process of our present invention is from between 100 and 1,000 times less. In a commercial hydrocracker experiencing fouling problems, this difference may amount to annual savings of hundreds of thousands of dollars.

Preferably in the process of our present invention, the stream from the adsorbent column is monitored utilizing synchronous-scanning fluorescence, or "SSF". In this method, both the excitation and emission wavelengths are scanned simultaneously. Each is offset by a certain wavelength difference. This allows analysis of general polycyclic aromatic-containing streams without the need to separate the compounds. In the case of the stable polycyclic aromatic dimers we have discovered to be the fouling compounds, this offset value is in the range of between 5 to 10 nanometers, with 6 nanometers being optimum when analyzing in trichlorobenzene, the preferred solvent. Trichlorobenzene use as a solvent assures that the PAD compounds will be completely in solution. The wavelength range for the PAD compounds is from about 500 to about 550 nanometers. Dicoronylene has a signal at about 508 nm and coronylovalene at about 545 1 nm.

Surprisingly, we found that it was possible to discern the presence of extremely small concentrations fouling large, stable PAD compounds in a mixture of polycyclic aromatics many times, even hundreds of times, more concentrated. We discovered the smaller-ringed aromatics leave a "window" range of fluorescence corresponding to the fluorescence range of the fouling PAD's.

We have found it preferable that during operation the absorbent vessel be loaded to about 10 wt% of dicoronylene, although alternatively monitoring for another large stable PAD is also possible.

For example, a typical commercial hydrocracker of 40,000 BPOD with the concentrations of PAD we have discovered would have an adsorber cycle time of about six months using an adsorber bed of about 500 $ft^3$ in a vessel of about 6 feet by 20 feet. It may be preferable however to use a thinner, or longer, or even multiple absorber vessels to minimize bypassing.

In the monitoring process embodiment of our present invention, effluent from the adsorption unit is monitored, as well as the bottoms effluent-containing feedstream to the adsorption unit. At a point when, for example, the dicoronylene level in the adsorption unit effluent reaches a predetermined percent of that in the feedstream to the adsorber, the adsorption unit is taken off-stream and the adsorbent regenerated. We have preferred a 50 percent relative concentration of dicoronylene, but it is recognized that the particular cut-off point is a function of site specific variables. Following an adsorption cycle, the adsorbent may be replaced or renewed by oxidation regeneration. The oxidation may be carried out in-situ within the adsorption unit, or ex-situ.

Referring again to FIG. 2, stream 32 from the adsorption unit 30 represents the return stream having a lower PAD concentration than heavy effluent stream 42 due to PAD removal in the adsorption zone. Stream 43 having a lower concentration of PAD compounds relative to stream 42, is routed back to the hydrocracking zone 5 to be contacted again with the amorphous or zeolitic catalyst. It should be noted that although the embodiment of the present invention depicted in FIG. 2 is a single-stage hydrocracker, the process is also applicable to the second-stage reactor in a two-stage hydrocracking process.

In the adsorption zone 30, it is preferred that only a portion of the total heavy effluent stream 42 is contacted with the adsorbent. We prefer a slipstream amount of between about 5% and about 20% as optimum. The slipstream volume is set to assure that a sufficient quantity of fouling PAD are removed to keep the PAD concentration below the solubility limit in stream 42, in any other stream in the recycle loop, or any in other portion of the heavy effluent-contacting process equipment. Having sufficient quantity of PAD removed in the adsorption zone 30 to allow the liquid hydrocarbon material present in the exemplary process of FIG. 2 not to interfere with refinery equipment is one of the principal objects of the present invention.

The adsorber is preferably operated at a temperature of between about 200° F. and about 700° F., and at a pressure of from about 30 to about 300 psig. Excessive removal of hydrocarbon liquid, or "bleeding", as depicted by stream 41, and which prior to this invention was commonly practiced, is significantly reduced or eliminated by employing the process of the present invention. We have found reduction in the bleedstream to be from the range of about 1.5 LV%-5.0 LV% to about 0.5 LV% or less in the practice of our present invention.

The optimum cycle time for the adsorption unit is determined by a number of variables, including level of stable polycyclic aromatic dimers in the heavy effluent from the hydrocracker, adsorbent cost, Whether more than one adsorber is installed. These factors are recognized by one skilled in the art of hydrocarbon processing.

The following examples of various aspects related to the present invention are intended to help exemplify the invention, but are not intended to limit the invention in any manner.

EXAMPLE I

Quantification of Polycyclic Aromatic Dimer Foulant

A deposit containing oil from a hydrocracker was obtained during a shutdown. This sample was stored two weeks and then treated by exhaustive extraction with dichloromethane using a Soxhlet extractor to give a deposit residue.

Spectrofluorescence was used to detect PAD's presence in the samples. Using a Perkin-Elmer Model MFP-66 spectrofluorometer with synchronous scanning, trace level mixtures of PAD's were measured without the need to separate them. The highest wavelength excitation and lowest wavelength emission maxima of these PADs differ by about 5-20 nm. When both the excitation and emission monochromators of the spectrofluorometer were scanned synchronously with preset delta wavelength values, single spectral bands occurred for each PAD. In this manner, the other excitation bands that were greater than the delta value away from the lowest emission wavelength were not seen nor were emission bands that were greater than delta away from the highest excitation band.

The analysis of hydrocracker deposit residue remaining (after exhaustive extraction With dichloromethane) by mass spectrometry showed two homologous series with starting masses of 596 and 694. These were believed to be fusion products of two coronene molecules or a coronene and an ovalene molecule, respectively, yielding PADs named dicoronylene and coronylovalene. These assignments were strongly suggested because other isomers that might occur would have resulted from sequential one-ring additions. No other intermediate PADs were seen, so a series of one-ring additions is unlikely.

A saturated solution of the deposit residue in 1,2,4-trichlorobenzene (TCB) was prepared and examined by field desorption mass spectrometry and spectrofluorescence. The spectral characteristics of pure dicoronylene and the hydrocracker residue were examined. Comparison excitation spectra of the two showed almost identical patterns, except that the pattern for the residue was shifted to slightly higher wavelengths due to alkyl substitution.

For Synchronous Scanning Fluorescence (SSF), a delta value of 6 nm was used, since this was found to be the band difference for a solution of pure dicoronylene. This delta value necessitated monochrometer slit widths of 2 nanometers. A saturated solution was too concentrated for direct analysis, so a standard solution was prepared. In order to obtain a solution that was dilute enough, 345 micrograms was weighed on a microbalance and dissolved in 500 ml TCB. Five milliliters of this solution was then diluted to 1:100.

The synchronous scan of this solution showed two major peaks: the first, centered at 510 nm, is due to the Dicoronylenes and the second peak, centered at 545 nm, is believed to be due to the coronylovalene. (The ratio of these two peaks is approximately the proportion seen for the total concentration of these classes reported by mass spectrometry.) A more concentrated sample showed an additional peak at 610 nm which is most likely due to "diovalenylene" resulting from the condensation of two ovalene molecules.

Duplicate samples of a hydrocracker feed and a hydrocracker recycle oil were synchronously scanned. The feed samples did not show a distinct peak in the spectral range that is characteristic for dicoronylenes, but the recycle oil samples did. The sample concentrations in TCB used were 1.0 g/10 ml for the feeds and 0.1 g/10 ml for the recycle oils. When the recycle oil peaks are compared to the deposit "standard", the concentrations for dicoronylenes in the first sample is 70 parts-per-billion (ppb) and 85 ppb for the second sample.

EXAMPLE II

Method Applied to Refinery Process

Vacuum gas oil having a boiling point in the range 650°-1100° F. from a crude unit vacuum column or residual desulphurization unit vacuum column is fed to an extinction hydrocracking reactor.

Ten percent of the heavy effluent (at 400° F.) from the hydrocracking reactor having foulant stable polycyclic aromatic dimers present is contacted with an adsorbent in accordance with our present invention.

The cleansing of stable polycyclic aromatic dimer compounds from the heavy effluent stream in this example eliminates the bleed stream amount equal to about 5 LV% of hydrocracker feed from the fractionator bottoms in order to reduce the build-up of such foulants in the system. Thus, a greater quantity of hydrocracked material is ultimately converted to valuable gasoline, jet, diesel and other products in the hydrocracker, and produces an overall increase in product revenue attributable to the improved process.

Summary economics indicate an annual savings of between about $100,000 to $2,000,000 per year, depending on refinery configuration, to be realized from a capital investment of about $100,000, constituting the adsorption equipment described above.

Additional modifications and improvements utilizing the discoveries of the present invention that are obvious to those skilled in the art from the foregoing disclosure and drawings are intended to be included within the scope and purview of the invention as defined in the following claims.

What is claimed is:

1. A process for removing stable polycyclic aromatic dimers present in hydrocracker effluents comprising the steps of:

(a) recovering a heavy effluent stream from a hydrocracker which heavy effluent stream comprises stable polycyclic aromatic dimer compounds and smaller-ringed aromatic compounds;

(b) contacting at least a portion of the heavy effluent stream with an adsorbent contained in an absorbent zone whereby a major portion of stable polycyclic aromatic dimer compounds contained in the heavy effluent stream are retained and a majority of the smaller-ringed aromatics elute from the adsorption zone to produce an adsorber effluent stream having a reduced concentration of stable polycyclic aromatic dimer compounds;

(c) monitoring the adsorber effluent stream using Synchronous Scanning Fluoresence and regenerating the adsorbent when the concentration of polycyclic aromatic dimer compounds in the adsorber effluent stream reach a predetermined concentration; and (d) recycling at least a portion of adsorber effluent stream to the hydrocracking reactor.

2. The process of claim 1 wherein the heavy effluent is at least a portion of a bottoms stream from a fractionator.

3. The process in accordance with claim 1 wherein the hydrocarbonaceous feedstock is vacuum gas oil.

4. The process in accordance with claim 1 wherein the hydrocarbonaceous feedstock has been contacted with a desulfurization catalyst prior to the hydrocracking reactor.

5. The process in accordance with claim 1 wherein the adsorbent is selected from the group consisting of alumina and silica gel.

6. The process in accordance with claim 1 wherein the hydrocracking reactor is a fixed-bed reactor.

7. The process in accordance with claim 4 wherein the contacting step (b) occurs in the heavy effluent recycle stream derived from a second stage of a two-stage hydrocracking reactor.

8. A process for removing stable polycyclic aromatic dimer compounds from a refinery stream comprising the steps of:

(a) contacting at least a portion of the refinery stream with an adsorbent to produce a cleaned stream containing a reduced concentration of stable polycyclic aromatic dimer compounds; and (b) monitoring the cleansed stream using Synchronous Scanning Fluorescence and regenerating the adsorbent when the concentration of polycyclic aromatic dimer compounds in the cleansed stream reach a predetermined fraction of the polycyclic aromatic dimer concentration in the refinery stream.

9. A process in accordance with claim 8 wherein the adsorbent is selected from the group consisting of alumina and silica gel.

10. A process in accordance with claim 9 wherein the hydrocarbonaceous feedstock effluent stream in vacuum gas oil.

11. In a hydrocracking process comprising the steps of contacting a hydrocarbonaceous stream with a hydrocracking catalyst in a hydrocracking zone to form a heavy effluent stream, bleeding from the heavy effluent stream a stream which comprises stable polycyclic aromatic dimer compounds and smaller-ringed aromatic compounds; the improvement comprising the steps of:

(a) contacting at least a portion of the bleed stream with an adsorbent in an adsorbant zone whereby a major portion of stable polycyclic aromatic dimer compounds contained in the bleed stream are retained and a majority of the smaller-ringed aromatic elute from the adsorption zone to produce an adsorber effluent stream having a reduced concentration of stable polycyclic aromatic dimer compounds; and, (b) monitoring the concentration of stable polycyclic aromatic dimer compounds in the adsorber effluent stream using Synchronous Scanning Fluorescence; and, (c) regenerating the adsorbent when the Synchronous Scanning Fluorescence determined concentration of the stable polycyclic aromatic dimer compounds reach a predetermined level; and, (d) recycling at least a portion of adsorber effluent stream to the hydrocracking reactor.

* * * * *